United States Patent [19]

Valk

[11] Patent Number: 5,001,030

[45] Date of Patent: Mar. 19, 1991

[54] METHOD AND MEANS FOR TRANSFERRING ELECTROSTATICALLY CHARGED IMAGE POWDER

[75] Inventor: Johannes Valk, Meerlo, Netherlands

[73] Assignee: OCE-Nederland B.V., Venlo, Netherlands

[21] Appl. No.: 420,046

[22] Filed: Oct. 11, 1989

[30] Foreign Application Priority Data

Oct. 13, 1988 [NL] Netherlands ..... 8802512

[51] Int. Cl.[5] ..... G03G 13/14

[52] U.S. Cl. ..... 430/98; 430/126

[58] Field of Search ..... 430/98, 120, 122, 126

[56] References Cited

U.S. PATENT DOCUMENTS 3,627,523 12/1971 Sheltto ..... 430/98
3,854,974 12/1974 Sato et al. ..... 430/98
4,746,589 5/1988 Haneda et al. ..... 430/98

*Primary Examiner*—John Goodrow
*Attorney, Agent, or Firm*—Reed Smith Shaw & McClay

[57] ABSTRACT

A method and apparatus for transferring a powder image, consisting of electrostatically charged developing powder, from an image forming medium to an image receiving medium by bringing the image forming medium with the powder image thereon into contact with the image receiving medium, which is provided with a resiliently deformable surface layer. During contact a pressure is exerted between said image forming medium and the image receiving medium with the powder image therebetween, which transfer pressure is sufficient to transfer the powder image to the image receiving medium. In the contact zone an electric field is applied across the image forming medium and the image receiving medium in such direction that the electrostatically charged developing powder is subjected to a force towards the image forming medium.

2 Claims, 1 Drawing Sheet

METHOD AND MEANS FOR TRANSFERRING ELECTROSTATICALLY CHARGED IMAGE POWDER

FIELD OF THE INVENTION

The present invention relates to a method for transferring electrostatically charged powder images from an image forming medium to an image receiving medium, and, in particular, to a method and apparatus which in combination with pressure transfers the images to an intermediate transfer means while applying an electric field across the mediums.

BACKGROUND OF THE INVENTION

Developing powder in which the particles have a charge opposite to that of the charge image to be developed is frequently used for developing electrostatic charge images formed on a suitable image forming medium in electrophotographic or electrostatic image forming processes. Normally, the charge on the powder particles is obtained by tribo-electric charging against a part of the developing device or against carrier particles mixed with the developing powder. Lack of uniformity frequently occurs in the development of large solid image areas with such developing powder. Such non-uniformity can be due to various reasons, such as vibration and impacts in the drive system for the image forming medium and/or the developing device, exhaustion of the stock of developing powder on the developing means, and divergence of the outgoing electric field in the case of large solid image areas (known as "edge field effects").

When such a non-uniformly developed image is transferred in an electric field (as is conventional) to a receiving material and then fixed thereon, the result is an image area with a non-uniform optical density. Typically, the edges have a greater optical density than the central part of the area. In the case of development with black developing powder this defect is less visible than in color developing where the defect is very distracting. Accordingly, it is an object of the invention to provide a means and method for reducing or eliminating this defect.

It has surprisingly been found that the visual defect can be eliminated by the application of an electric field across the image forming medium and the image receiving medium in a direction such that the electrostatically charged developing powder is subjected to a force directed towards the image forming medium during pressure contact between the two mediums. Although the pressure adhesion transfer step is already known from U.S. Pat. No. 3,591,276, it has been found that the combination of adhesion transfer and a counteracting electric field gives the surprising result that a uniform thickness of the developing powder layer is obtained on the image receiving medium. The use of an electric field to transfer a toner image from an image forming medium to an image receiving medium is very well known for instance from U.S. Pat. No. 3,734,724, it discloses a conventional transfer method where developed images are transferred by an electric field from a transparent photoconductive element, e.g.. conductive film, to a metal receiving medium, e.g.. lithographic plate or non-metallic medium wherein an electrical repelling potential is applied to the receiving medium, just before the transfer zone to prevent premature transfer of toner particles.

In Japanese Application 59-50474 a supporting electric field is applied, directing from the image forming medium to a receiving belt, to improve the transfer rate of the pressure transfer step.

SUMMARY OF THE INVENTION

Generally, the present invention provides a method and means for applying an electric field across the image forming medium and the receiving media in a direction towards the image forming media.

According to the invention, the layer of developing powder is not completely transferred at those parts of the image areas (edges) which have been too intensively developed, but at the less developed parts (the central parts) of an image area the powder layer is transferred intact, so that a uniform area filling is obtained on the copy.

Other advantages of the invention will become apparent from a description of an electrophotographic apparatus using a presently preferred embodiment of the invention taken in connection with the accompanying diagrammatic drawing.

PRESENTLY PREFERRED EMBODIMENT

Figure 1:
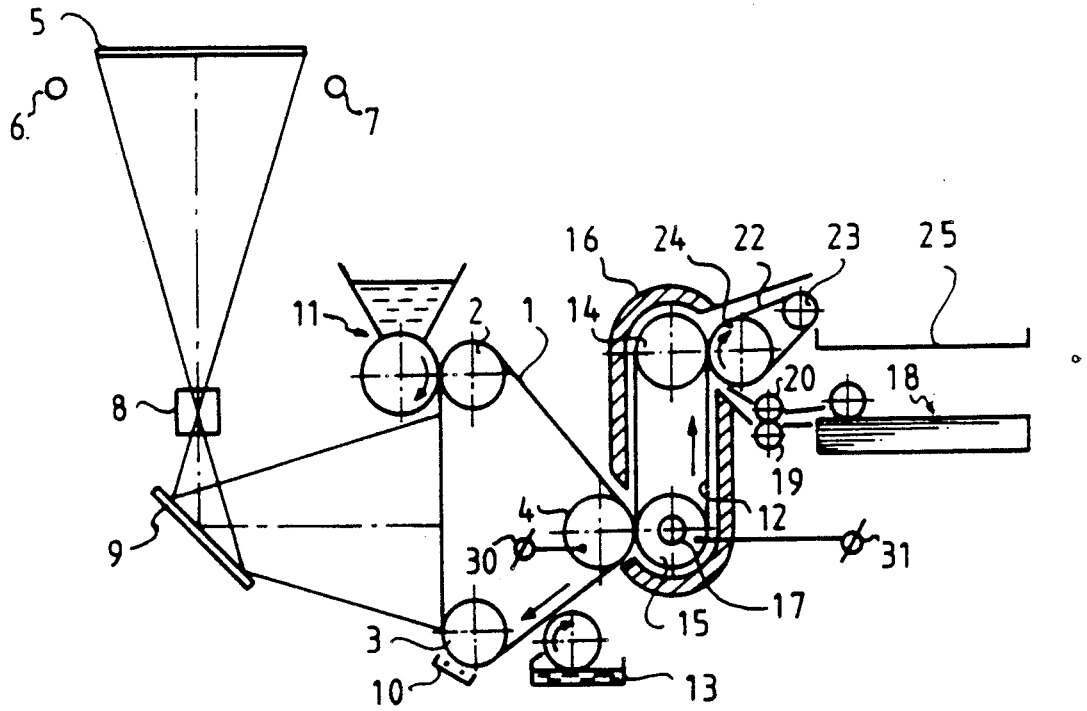
FIG. 1 is a diagrammatic representation of an electrophotographic copying machine incorporating the apparatus and process of the present invention.

Referring to FIG. 1, an endless photoconductive belt 1 is driven at a uniform speed by means of drive or guide rollers 2, 3 and 4. The image of an original disposed on platen 5 is projected by flashbulbs 6 and 7, through lens 8 and mirror 9 onto belt 1 after belt 1 has been electrostatically charged by corona device 10.

After the flash exposure, the latent charge image formed on belt 1 is developed by a magnetic brush device 11 to give a powder image which is then brought into pressure contact with an endless intermediate belt 12 at a first transfer zone. Belt 12 is preferably made of or covered with a soft resilient, heat-resistant material such as, for example, silicone rubber. At the first transfer zone, powder image is transferred by adhesion forces from belt 1 to belt 12.

After the image transfer, any remaining image residues are removed from belt 1 by means of cleaning device 13. Belt 1 is thereafter ready for reuse.

Belt 12 is trained about drive and guide rollers 14 and 15 which are preferably located together with belt 12 in a space enclosed as much as possible by heat-insulating material 16. This enclosed space and, hence, belt 12 are heated by one or more heating elements in combination with infrared radiator 17 disposed inside roller 15. While belt 12 is advanced together with the powder image thereon, the powder image becomes tacky as a result of heating. In a second transfer zone the tacky powder image is then transferred under pressure to and fixed on a sheet of receiving material, for example paper, fed from reservoir 18 via rollers 19 and 20.

Finally, the resulting copy is deposited in tray 25 by belt 22 trained about rollers 23 and 24.

According to the invention, in the first transfer zone an electric field is applied at the first transfer zone via connections 30 and 31 across photoconductive belt 1 and intermediate belt 12. The direction of the field is such that the electrostatically charged toner powder is subjected to a force directed towards photoconductive belt 1. The thickness of the uniform layer of powder image to be formed on the belt 12 is selected by adjusting the dimension of the electric field.

Adjusting the dimension of the electric field is based, on the one hand, by the magnitude of the adhesion forces exerted by intermediate belt 12 on the powder particles and, on the other hand, by a number of material parameters, such as the thickness of the photoconductive layer on belt 1, the electrical resistance of the developing powder and the particle size of the developing powder. Using a silicone rubber intermediate belt, for example, excellent results have been obtained with a photoconductor layer thickness of between 0 and 25 μm and a counter-voltage of about 100V across the first transfer zone. The developing powder used had a specific resistance greater than $10^{14}$ ohms.cm and a particle size of between 2 and 80 μm.

It is understood that the invention is not restricted to the above combination of material parameters to provide an optimum electric field according to the invention. A person skilled in the art will find it fairly simple to determine experimentally the optimum value for the counter-voltage to be applied for each combination of the relevant parameters.

Thus, the invention is not restricted to insulating developing powders, but it is also possible to use more conductive developing powders which have become charged by induction.

The invention can also be used in image-forming processes in which a latent image is developed by means of non-charged developing powder, e.g., magnetographic processes. The powder particles in the powder image formed must then be electrostatically charged prior to the transfer step.

While a presently preferred embodiment of the invention has been described and shown, the invention may be otherwise embodied within the scope of the appended claims.

What is claimed is:

1. A method of transferring a powder image comprising electrostatically charged developing powder, from an image forming medium to an image receiving medium by bringing the image forming medium with the powder image thereon into contact with the image receiving medium having a resiliently deformable surface layer thereon and exerting a transfer pressure during contact between said image forming medium and the image receiving medium having said powder image therebetween, said pressure being sufficient to transfer said image to said receiving medium, the improvement in combination therewith comprising the step of applying an electric field across said image forming medium and said image receiving medium in a direction to force said electrostatically charged developing powder towards said image forming medium during transfer contact.

2. Apparatus for transferring an electrostatically charged powder image from an image forming medium to an image receiving medium having a resiliently deformable surface layer comprising pressure means for exerting a pressure on said image forming medium and said image receiving medium in a contact zone between said media to provide image transfer contact, and means for applying an electric field in said contact zone across said image forming and image receiving media in such direction that the electrostatically charged developing powder is subjected to a force towards said image forming medium.

* * * * *